US007885578B2

(12) United States Patent
Yoshino

(10) Patent No.: US 7,885,578 B2
(45) Date of Patent: Feb. 8, 2011

(54) GRID ELECTRODE, IMAGE FORMING APPARATUS INCLUDING SAME, AND PROCESS CARTRIDGE INCLUDING SAME

(75) Inventor: Kaoru Yoshino, Tokyo (JP)

(73) Assignee: Ricoh Company Limited, Tokyo (JP)

( * ) Notice: Subject to any disclaimer, the term of this patent is extended or adjusted under 35 U.S.C. 154(b) by 337 days.

(21) Appl. No.: 12/081,161

(22) Filed: Apr. 11, 2008

(65) Prior Publication Data

US 2008/0253805 A1 Oct. 16, 2008

(30) Foreign Application Priority Data

Apr. 13, 2007 (JP) ..... 2007-106153

(51) Int. Cl.
*G03G 15/02* (2006.01)

(52) U.S. Cl. ..... 399/171

(58) Field of Classification Search ..... 399/171; 361/229; 250/324–326
See application file for complete search history.

(56) References Cited

U.S. PATENT DOCUMENTS

| | | | | |
|---|---|---|---|---|
| 5,025,155 | A * | 6/1991 | Hattori | 250/326 |
| 5,079,668 | A | 1/1992 | Maeshima | |
| 5,206,784 | A * | 4/1993 | Kimiwada et al. | 361/229 |
| 5,216,465 | A | 6/1993 | Arai et al. | |
| 5,526,222 | A | 6/1996 | Fender | |
| 5,666,604 | A | 9/1997 | Nakagami et al. | |
| 5,844,768 | A * | 12/1998 | Yamanaka | 361/229 |
| 6,091,917 | A | 7/2000 | Aoki | |
| 6,421,514 | B2 * | 7/2002 | Yamanaka et al. | 399/169 |
| 6,553,198 | B1 * | 4/2003 | Slattery et al. | 399/171 |
| 6,963,708 | B2 * | 11/2005 | Sekovski et al. | 399/171 |

FOREIGN PATENT DOCUMENTS

| | | |
|---|---|---|
| JP | 61-88282 | 5/1986 |
| JP | 63-118050 | 7/1988 |
| JP | 1-166356 | 11/1989 |
| JP | 2-267571 | 11/1990 |
| JP | 2000-330361 | 11/2000 |
| JP | 2005-338797 | 12/2005 |

OTHER PUBLICATIONS

U.S. Appl. No. 12/099,496, filed Apr. 8, 2008, Yoshino, et al.

* cited by examiner

*Primary Examiner*—Robert Beatty
(74) *Attorney, Agent, or Firm*—Oblon, Spivak, McClelland, Maier & Neustadt, L.L.P.

(57) ABSTRACT

A grid electrode, which can be included in a scorotron charger for an image forming apparatus or a process cartridge, includes a thin plate member containing multiple apertures and linear patterns, and fitting members. The multiple apertures are disposed facing a charge wire, and the linear patterns are formed in the longitudinal direction of the grid electrode and disposed at equally-shaped intervals in a lateral direction thereof to cause the fitting member to apply tension in the longitudinal axis of the thin plate member at end portions in the lateral direction of the fitting member. The fitting members engage hooks mounted on the scorotron charger at both ends of the grid electrode in a longitudinal direction of the thin plate member containing the multiple apertures and linear patterns.

15 Claims, 8 Drawing Sheets

GRID ELECTRODE, IMAGE FORMING APPARATUS INCLUDING SAME, AND PROCESS CARTRIDGE INCLUDING SAME

PRIORITY STATEMENT

The present application claims priority under 35 U.S.C. §119 from Japanese Patent Application No. 2007-106153, filed on Apr. 13, 2007 in the Japan Patent Office, the contents and disclosures of which are hereby incorporated by reference herein in their entirety.

BACKGROUND

1. Field of the Invention

Exemplary embodiments of the present invention generally relate to a grid electrode provided to a scorotron charger, an image forming apparatus including the grid electrode provided to the scorotron charger, and a process cartridge integrally including the scorotron charger having the grid electrode.

2. Discussion of the Related Art

Related-art electrophotographic image forming apparatuses generally include a charging unit that uses a configuration employing a corotron charger or a scorotron charger to uniformly charge a surface of a photoconductive element or photoconductor. Such a known scorotron charger may be provided with a shield case to include components such as a charge wire and a grid electrode. The charge wire may be disposed facing or opposed to the surface of the photoconductor with a given gap therebetween. The grid electrode may be planar-shaped with aperture patterns, and be disposed closer to the photoconductor than the charge wire is.

High-voltage energization of the charge wire causes corona discharge, so that the surface of the photoconductor can be charged to a substantially same potential as the grid electrode.

To achieve a desired ability to control the potential of the photoconductor (hereinafter, "potential controllability"), it is preferable that the photoconductor and the grid electrode are equally spaced therebetween over an entire area in a lateral direction of the grid electrode or in a moving direction or rotation direction of the photoconductor.

When the photoconductor includes a flat belt, the above-described arrangement can be accomplished easily, even with respect to apertures such as a plurality of long mesh apertures, for example, hexagonally arranged apertures.

However, most photoconductors are drum-shaped, that is, with curvature, and therefore it is difficult to dispose the grid electrode along the curvature of the drum-shaped photoconductor when the grid electrode has apertures of hexagonal shape or stripe shape.

There has been an attempt to arrange a related-art grid electrode along the curvature of a drum-shaped photoconductor. However, when the related-art grid electrode that has patterns of a plurality of hexagons and stripes is pulled or extended from each end in a longitudinal direction thereof, tension cannot be evenly provided or uniformly distributed across the related-art grid electrode. Specifically, the tension may be less at the center portion of the grid electrode than at both end portions of the grid electrode. Therefore, the grid electrode cannot form a circular arc, and thus the distance between the photoconductor and the grid electrode cannot be kept constant, which means that the charging of the photoconductor surface is uneven and results in uneven density of the resulting reproduced image and hence poor image quality.

In another attempt, a different related-art grid electrode has been made flat and disposed facing the surface of a drum-shaped photoconductor. However, this configuration causes unevenness of distances between the flat-shaped grid electrode and the drum-shaped photoconductor. Specifically, a distance between the flat-shaped grid electrode and the drum-shaped photoconductor is shortest at a center portion in the lateral direction or across the grid electrode with respect to the photoconductor, and the distance becomes greater as the portion where the flat-shaped grid electrode faces the photoconductor moves away from the center portion toward the both ends in the lateral direction of the grid electrode. As a result, the potential controllability of the photoconductor deteriorates extremely at both ends thereof.

Yet another attempt has been made to arrange a related-art grid electrode along the curvature of a drum-shaped photoconductor. However, no data for the grid electrode including its patterns was disclosed and no examples of effective patterns to improve the potential controllability and charging nonuniformity were shown.

Yet another attempt has been performed using a grid electrode having apertures of linear patterns in a longitudinal direction only. The grid electrode was provided with a fitting member arranged at a center part of both ends in a lateral direction or across the apertures of linear patterns so as to extend the grid electrode in a longitudinal direction thereof by engaging each fitting member with a hook mounted on another component or unit in an image forming apparatus.

With the above-described configuration, the intervals or space between the linear-shaped apertures of the grid electrode and the drum-shaped photoconductor can be constantly provided in the lateral direction of the grid electrode. However, it is difficult to provide constant intervals or space between the grid electrode and the drum-shaped photoconductor over an entire area in the longitudinal direction of the grid electrode. Therefore, potential deviations in the longitudinal direction of the drum-shaped photoconductor were generated, which is likely to cause unevenness in the charge applied to the photoconductor, resulting in unevenness or non-uniformity in the density of reproduced images.

SUMMARY OF THE INVENTION

In light of forgoing, the inventor of the present invention proposes to provide, in at least one embodiment, a grid electrode included in a scorotron charger.

Exemplary aspects of the present invention have been made in view of the above-described circumstances.

Exemplary aspects of the present invention provide a grid electrode that can effectively maintain a constant distance between an image bearing member and a grid electrode both in a longitudinal direction and a lateral direction of the grid electrode, so that potential variations may not occur and therefore desirable potential controllability can provide image forming without density nonuniformity.

Other exemplary aspects of the present invention provide an image forming apparatus that can include a scorotron charger having the above-described grid electrode.

Other exemplary aspects of the present invention provide a process cartridge that can include a scorotron charger having the above-described grid electrode.

In at least one exemplary embodiment of the present invention, a grid electrode is disposed facing a charge wire, and includes a thin plate member and fitting members. The thin plate member contains multiple apertures formed in a longitudinal direction on a surface of the thin plate member of the grid electrode facing the charge wire, and multiple linear patterns formed in the grid electrode in the longitudinal direction of the grid electrode to form each of the multiple apertures therebetween. The multiple linear patterns are disposed at equally-shaped intervals in a lateral direction of the grid electrode. The fitting members are provided at either end portion in the longitudinal direction of the thin plate member containing the multiple apertures, and configured to engage respective hooks mounted on a scorotron charger including the grid electrode. The fitting members extend to cause a tension force exerted in the longitudinal direction of the multiple apertures to be applied uniformly over the end portions of the thin plate member in the lateral direction of the fitting members.

Each of the fitting member may include a part having a given angle with respect to the longitudinal direction thereof. The fitting members may be symmetrical about a longitudinal axis thereof.

Each of the fitting members may be symmetrical about an axis perpendicular to the longitudinal axis thereof.

Further, in at least one embodiment of the present invention, an image forming apparatus includes an image bearing member configured to bear an image on a surface thereof, and a scorotron charger configured to charge the surface of the image bearing member. The scorotron charger may include a shield case, a charge wire extended in a longitudinal direction of the shield case, and the above-described grid electrode.

Further, in at least one embodiment of the present invention, a process cartridge detachable with respect to an image forming apparatus includes an image bearing member configured to bear an image on a surface thereof, and a scorotron charger configured to charge the surface of the image bearing member. The scorotron charger may include a shield case, a charge wire extended along a longitudinal direction of the shield case, and the above-described grid electrode.

BRIEF DESCRIPTION OF THE DRAWINGS

The accompanying drawings are intended to depict example embodiments of the present patent application and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
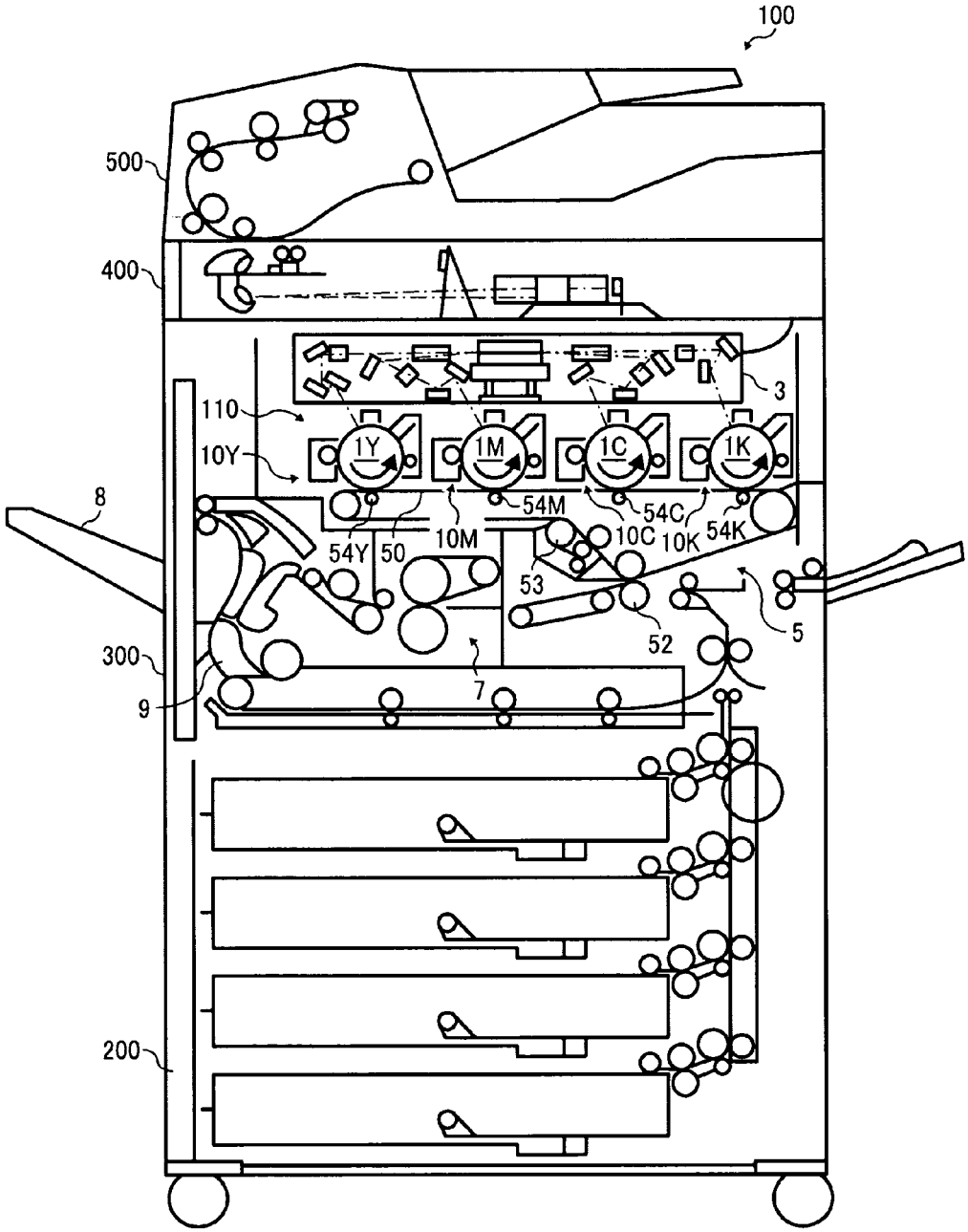
FIG. 1 is a schematic front view of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Exemplary embodiments of the present invention are described below with reference to the accompanying drawings. The present invention may apply to an image forming apparatus such as a copier, printer, facsimile machine, plotter, multifunctional apparatus including functions of at least one of the copier, printer, facsimile machine, and plotter, and so forth.

Referring to FIG. 1, a schematic configuration of a full-color image forming apparatus 100 is described according to an exemplary embodiment of the present invention.

The full-color image forming apparatus 100 of FIG. 1 includes a sheet feeding part 200, an image forming part 300, a document reading part 400, and a document feeding part 500.

The sheet feeding part 200 includes multiple sheet feeding trays arranged in multiple stages in a vertical direction. Each of the multiple sheet feeding trays accommodate a given number of recording media or sheets therein.

The document reading part 400 includes moving bodies (not shown), an image forming lens (not shown), and a reading sensor (not shown), and reads an image of an original document placed on a surface of a contact glass (not shown).

The document feeding part 500 is disposed on the document reading part 400, and feeds an original document through sheet conveying path provided therein.

The image forming part 300 includes an image forming section 110, an optical writing device 3, a transfer device 5, and a fixing device 7.

The image forming section 110 includes four process cartridges 10Y, 10M, 10C, and 10K serving as image forming units arranged in parallel in an approximately horizontal direction in the image forming part 300.

The four process cartridges 10Y, 10M, 10C, and 10K are cartridge type units and can integrally include image forming components therein for forming corresponding color toner images. The process cartridges 10Y, 10M, 10C, and 10K include respective colors of toners different from each other, for example, yellow (Y), magenta (M), cyan (C), and black (K). The process cartridges 10Y, 10M, 10C, and 10K include photoconductors 1Y, 1M, 1C, and 1K, respectively. Each of the photoconductors 1Y, 1M, 1C, and 1K rotates in a counterclockwise direction as indicated by respective arrows in FIG. 1.

The suffixes provided to respective components are for indicating the color of toner used therefor.

Figure 2:
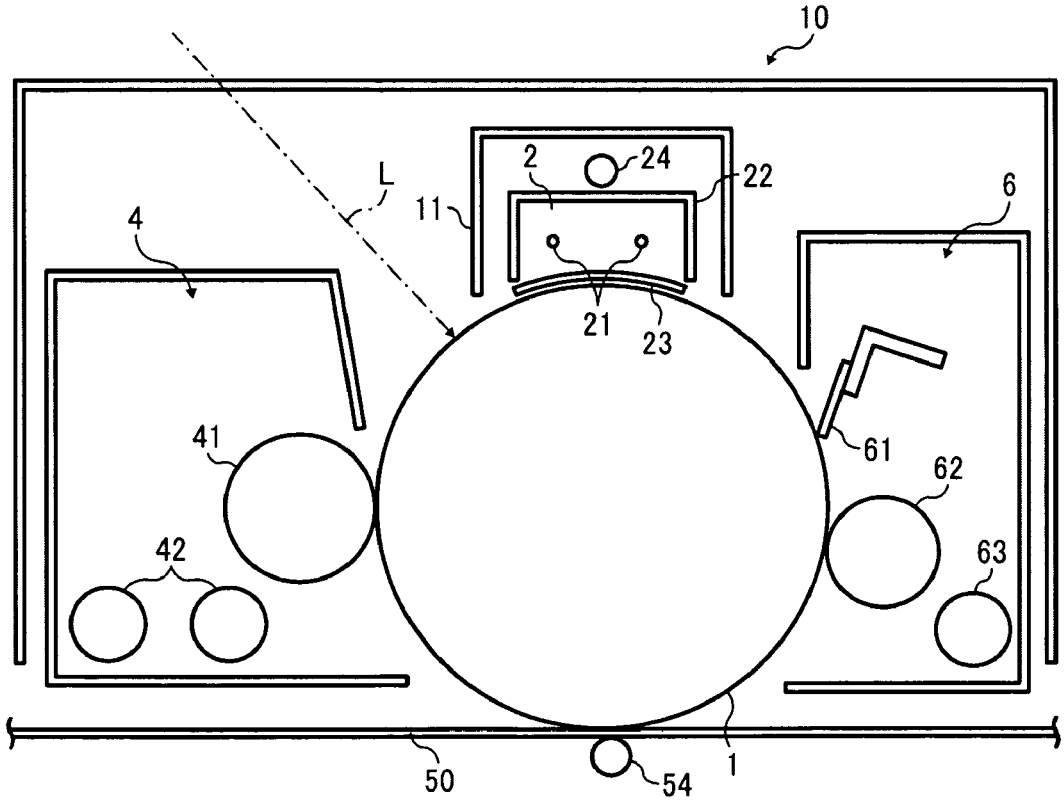
FIG. 2 is a schematic cross-sectional view of a process cartridge included in the image forming apparatus of FIG. 1.

Around each of the process cartridges 10Y, 10M, 10C, and 10K, image forming components, for example, a charging unit 2, a developing unit 4, and a cleaning unit 6 are disposed (see FIG. 2).

The optical writing device 3 is disposed above the process cartridges 10Y, 10M, 10C, and 10K of the image forming section 110. The optical writing device 3 converts image data read by the document reading part 400 or transmitted from an external device such as a personal computer (not shown), and causes a polygon mirror (not shown) that is driven by a polygon motor (not shown) to scan or read laser light beams L (see FIG. 2) to form an electrostatic latent image on a surface of the photoconductor 10 based on image data read through mirrors.

The transfer device 5 includes an intermediate transfer belt 50 having a form of an endless belt to sequentially receive toner images formed on the photoconductors 1Y, 1M, 1C, and 1K, so that an overlaid toner image can be formed on a surface of the intermediate transfer belt 50 and then be transferred onto a recording medium.

The intermediate transfer belt 50 has a base layer and an elastic layer. The base layer is formed by an unstretchable material or non-elastic material such as a fluorine contained resin, canvas or so forth. The elastic layer lies over the base layer and is formed by a material such as fluorine contained rubber, acrylonitrile-butadiene copolymer rubber, or so forth. The surface of the elastic layer is covered by a smooth coat layer coated by a material such as a fluorine contained resin.

The intermediate transfer belt 50 is extended by and spanned around multiple supporting rollers, and rotates in a clockwise direction as indicated by an arrow shown in FIG. 1 to convey a recording medium or sheet.

The transfer device 5 further includes an intermediate transfer belt cleaning unit 53 to remove residual toner remaining on the surface of the intermediate transfer belt 50 after the image transfer operation is completed.

Alternatively, the intermediate transfer belt 50 can serve as a sheet conveying belt so that the toner images formed on the photoconductors 1Y, 1M, 1C, and 1K can be sequentially and directly transferred onto the recording medium carried by the sheet conveying belt.

A primary transfer member 54 is disposed for each photoconductor 1 at a position facing the photoconductor 1 sandwiching the intermediate transfer belt 50. In the full-color image forming apparatus 100 according to an exemplary embodiment of the present invention, the primary transfer member 54 is a roller-type member. The primary transfer member 54 is connected to a power supply (not shown), and is supplied with a given voltage from the power supply. Therefore, when the toner image formed on the photoconductor 1 is transferred onto the intermediate transfer belt 50, the given voltage is applied to the primary transfer member 54 to form an electric field between the photoconductor 1 and the intermediate transfer belt 50, and as a result, the toner image is electrostatically transferred from the photoconductor 1 onto the intermediate transfer belt 50.

A secondary transfer roller 52 serving as a secondary transfer unit is disposed facing one of the supporting rollers, sandwiching the intermediate transfer belt 50.

The fixing device 7 is disposed next to the secondary transfer roller 52, and fixes the toner image to fix onto the recording medium. The fixing device 7 includes a heat belt and a pressure roller. The heat belt is stretched over a roller having a halogen heater or the like therein. The heat belt and the pressure roller provide a nip contact where heat and pressure are applied to the toner of the image formed on the recording medium to cause the toner image to be surely fixed onto the recording medium.

The configuration of the fixing device 7 is not limited to the above-described one. For example, the fixing device 7 may have a configuration using a pair of rollers or a pair of belts.

The full-color image forming apparatus 100 further includes a sheet discharging tray 8 and a reverse unit 9 for a duplex printing operation.

Referring to FIG. 2, a schematic configuration of the process cartridge 10 of FIG. 1 is described according to an exemplary embodiment of the present invention.

The process cartridge 10 of FIG. 2 includes the photoconductor 1 that may include amorphous metal, such as amorphous silicon, amorphous selenium, etc., or organic compound, such as bis-azo pigments, phthalocyanine pigments, etc. To achieve environmental advantage and efficient post-processing after use, it is preferable to use organic compound for the photoconductor 1.

The charging unit 2 according to an exemplary embodiment of the present invention may correspond to a scorotron charger 2 that includes a charge wire 21, a shield case 22, a grid electrode 23, and a power source (not shown).

The power source is connected to the charge wire 21 and the grid electrode 23 to apply a high voltage thereto, respectively, so as to generate corona discharge between the photoconductor 1 and the charge wire 21. This may result in a uniform charging over the surface of the photoconductor 1.

The grid electrode 23 is disposed along a curvature in the lateral direction of the photoconductor 1 to achieve desirable potential controllability.

In the vicinity of the charging unit 2, a charge cleaning unit 24 and an air duct 11 are disposed. The charge cleaning unit 24 is configured to provide stable chargeability even when the charging unit 2 changes with age. The air duct 11 is connected with another air duct (not shown) disposed at a backside of the full-color image forming apparatus 100, and exhaust air is discharged via an ozonation filter (not shown) to outside of the full-color image forming apparatus 100.

The developing unit 4 includes a developer bearing member 41 and a toner supplying screw 42.

The developer bearing member 41 carries developer thereon and supplies the developer to the photoconductor 1. The developer member 41 includes a developing sleeve member that has a hollow cylindrical shape and is rotatably supported, and a magnet roller that is coaxially fixed inside the developing sleeve member. When the developer bearing member 41 is rotatably driven, the developer is magnetically attracted and adsorbed onto a surface of the developing sleeve member, which forms a circumferential surface of the developer bearing member 41, so as to convey the developer onto the photoconductor 1.

The developing sleeve member of the developer bearing member 41 is formed of a conductive and non-magnetic member and is connected to a power source (not shown) to apply a developing bias. The power source applies a given voltage between the developer bearing member 41 and the photoconductor 1 to form an electric field in a development area.

The cleaning unit 6 includes a cleaning blade 61, a cleaning brush roller 62, and a used toner discharging screw 63, and removes residual toner remaining on the surface of the photoconductor 1 after a primary transfer operation to be ready for a next image forming operation.

The charging unit 2, the developing unit 4, the cleaning unit 6, and the photoconductor 1 may be integrally provided to the process cartridge 10 that is detachable with respect to the full-color image forming apparatus 100.

Figure 3:
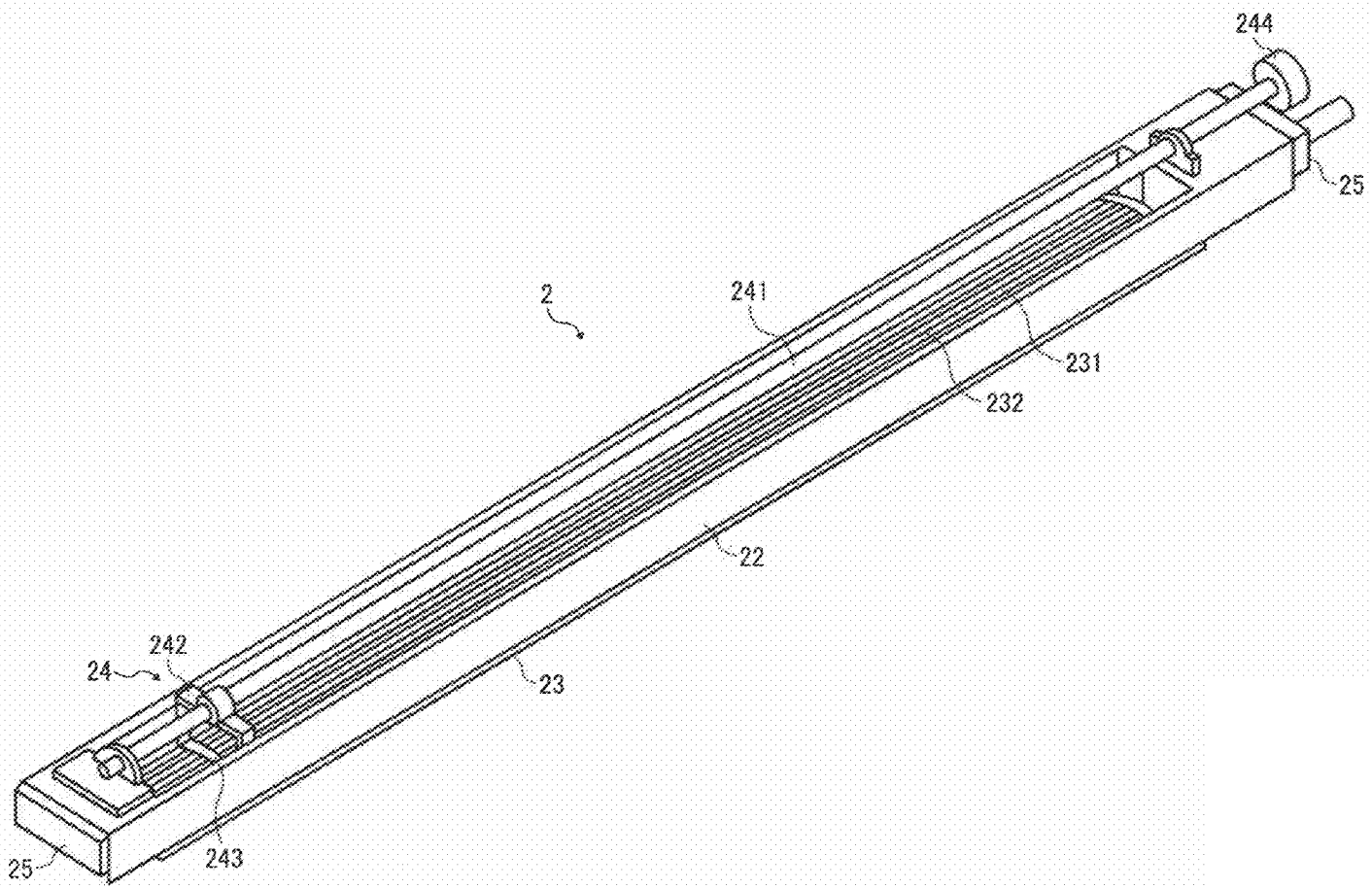
FIG. 3 is a perspective view of a scorotron charger included in the process cartridge of FIG. 2.
Figure 4:
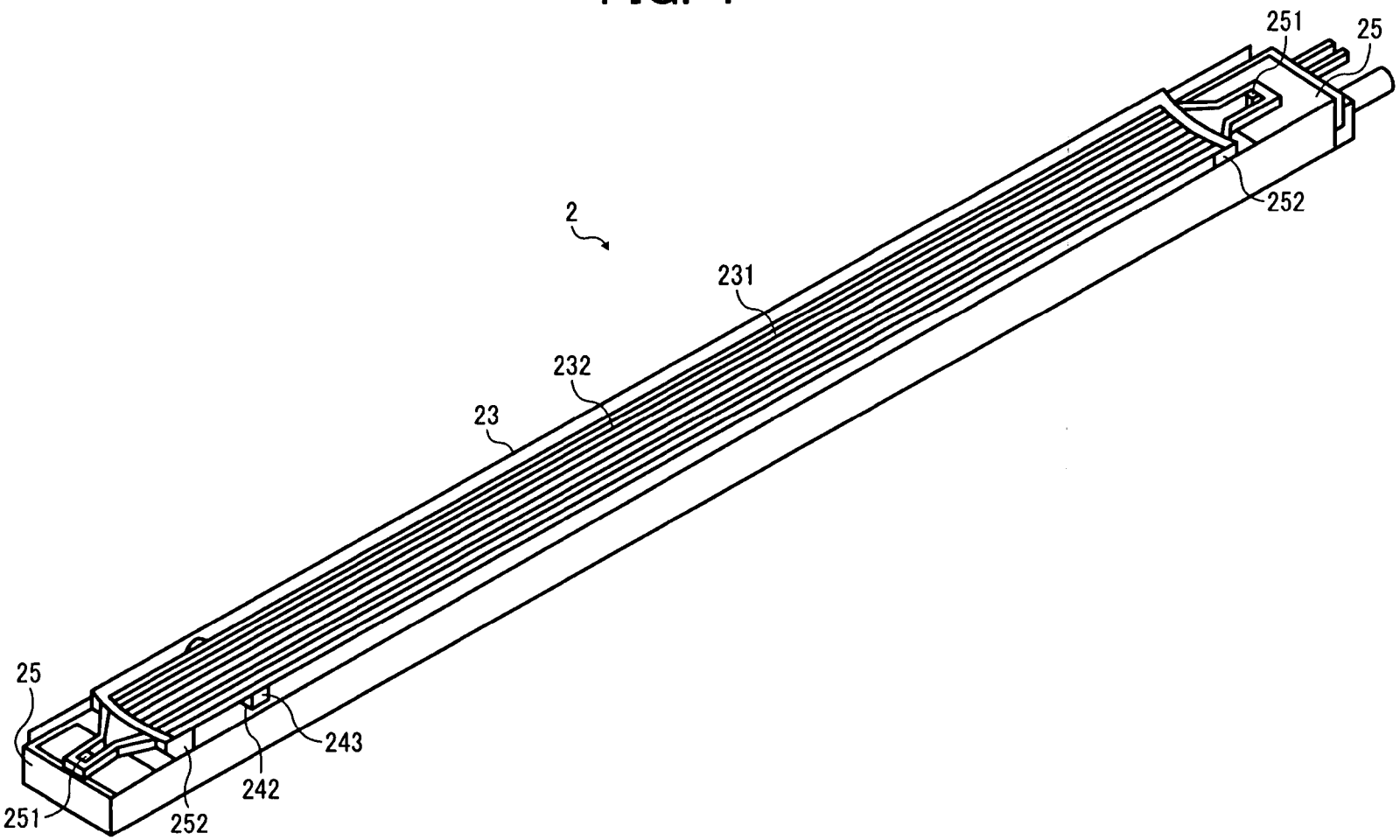
FIG. 4 is a perspective view of the scorotron charger of FIG. 3, viewed from the rear side of FIG. 3.

Referring to FIGS. 3 and 4, a detailed description is given of the charging unit 2 or the scorotron charger 2 according to an exemplary embodiment of the present invention.

The scorotron charger 2 further includes end blocks 25, each fixedly disposed at both ends in the longitudinal direction of the shield case 22. That is, the end blocks 25 are disposed at a front side and a back side of the full-color image forming apparatus 100.

The end blocks 25 are formed of an insulating resin, and fixedly attach the charge wire 21 and the grid electrode 23 thereto.

Figure 5A:
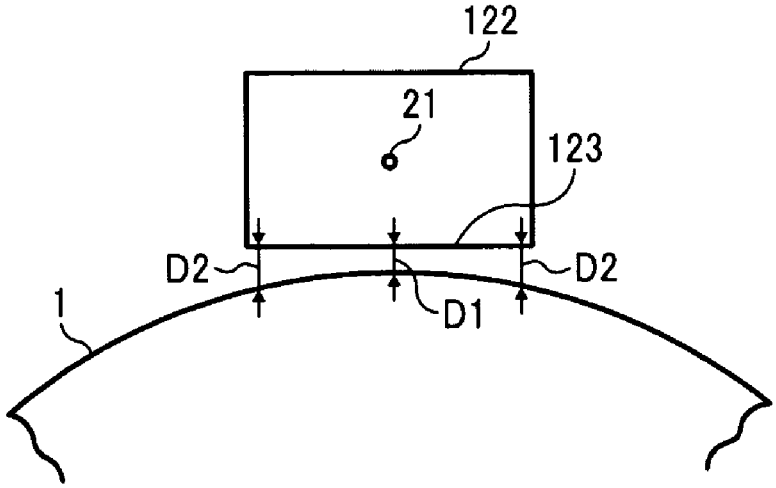
FIG. 5A is an example view showing a relation of distances of a grid electrode and a photoconductor.

When the grid electrode 23 has a flat surface as a known grid electrode 123 mounted on a shield case 122 shown in FIG. 5A, different distances are measured at various points between the grid electrode 123 and the surface of the photoconductor 1. Specifically, a distance D1 between the grid electrode 123 and the photoconductor 1 at a center portion in the lateral direction of the grid electrode 123 may be shorter than a distance D2 between the grid electrode 123 and the photoconductor 1 at edge portions in the lateral direction of the grid electrode 123.

To provide an equal distance both at the center portion and at the edge portion in the lateral direction of the grid electrode 23, the grid electrode 23 of FIGS. 3 and 4 is controlled to have a shape having a given curvature. The grid electrode 23 includes fitting units 233 (see FIG. 6) at both ends in the longitudinal direction thereof.

Figure 5B:
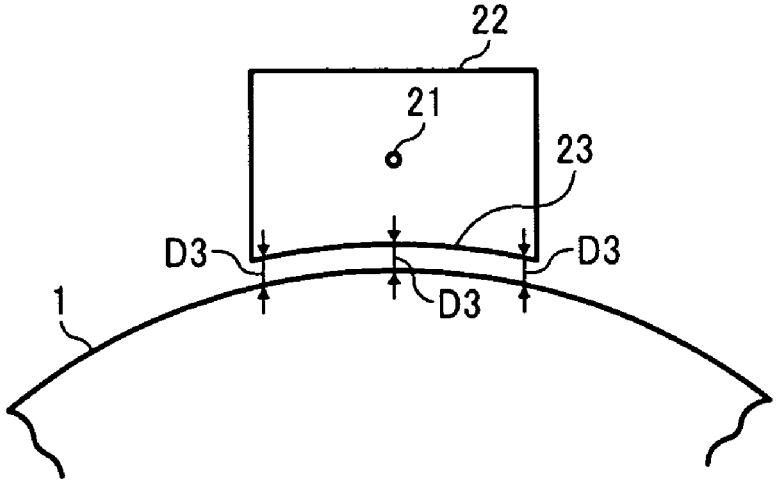
FIG. 5B is a view showing a relation of distances of the grid electrode and the photoconductor of the scorotron charger of FIG. 3.

The fitting units 233 of the grid electrode 23 are extended for engagement with respective hooks 251 (see FIG. 4) provided at both ends in the longitudinal direction of the respective end blocks 25. Since the thin wall member 234 that corresponds to a thin plate has elastic and deformational characteristics, the grid electrode 23 may be extended in an arc shape having a curvature according to an arc forming part 252 of the end blocks 25. Accordingly, the grid electrode 23 can have an equal distance D3 both at the center portion and at the end portion to the surface of the photoconductor 1, as shown in FIG. 5B.

In an exemplary embodiment of the present invention, a distance between the grid electrode 23 and the photoconductor 1 is set to approximately 2 mm.

As shown in FIGS. 3 and 4, the grid electrode 23 includes multiple slit-like apertures 231 and multiple linear patterns 232. The multiple linear patterns 232 are formed on a thin wall member 234 (see FIG. 6) of the grid electrode 23 in the longitudinal direction of the grid electrode 23, and the multiple slit-like apertures 231 are formed according to the multiple linear patterns 232 and extend along the multiple linear patterns 232. The multiple linear patterns 232 are disposed in constant intervals in a lateral direction of the grid electrode 23.

Hereinafter, the slit-like aperture 231 is also referred to as a "slit 231."

As shown in FIGS. 3 and 4, the charge cleaning unit 24 includes a feed screw 241, a slider 242, a grid cleaner pad 243, and a drive gear 244. Details of the components of the charge cleaning unit 24 will be described later.

Figure 6:
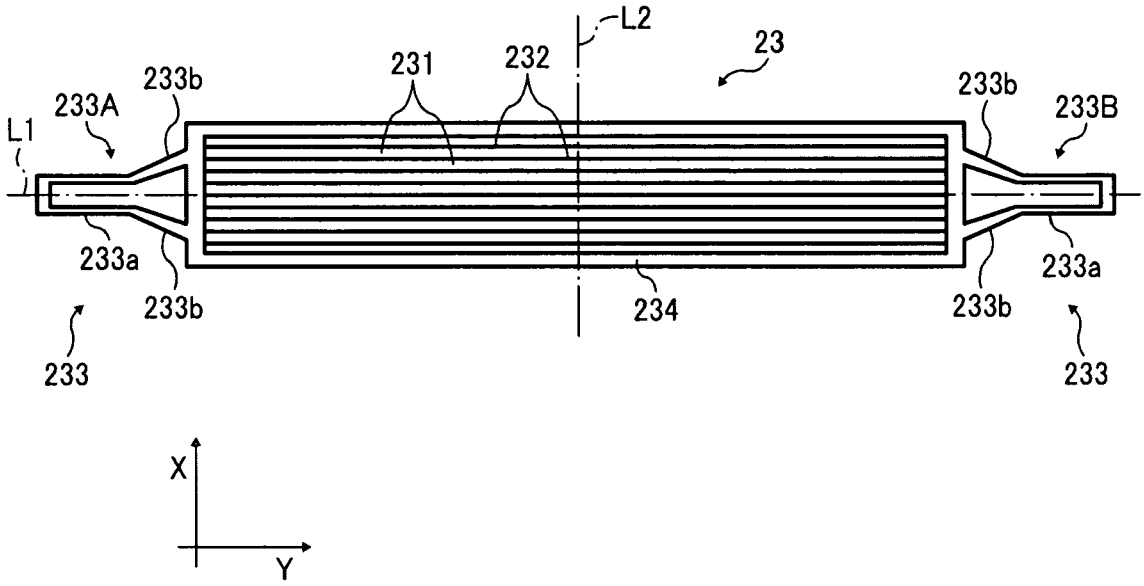
FIG. 6 is a plane view of a grid electrode included in the scorotron charger of FIG. 3.

Referring to FIG. 6, a detailed structure of the grid electrode 23 according to an exemplary embodiment of the present invention is described.

In FIG. 6, the fitting unit 233 includes fitting members 233A and 233B, which are integrally provided at both ends in the longitudinal direction or a direction "Y" of the grid electrode 23. Each of the fitting members 233A and 233B includes a U-shaped body 233*a* to be hooked to a corresponding one of the hooks 251 having a projecting shape on each end block 25, and a pair of arms 233*b* extending from the U-shaped body 233*a* outwardly in the lateral direction or a direction "X" to the end portion of the grid electrode 23.

While the U-shaped body 233*a* straightly extends in the longitudinal direction, the pair of arms 233*b* extends with an angle with respect to the longitudinal direction of the grid electrode 23. One end of the pair of arms 233*b* continues to extend toward portions close to the end portions in the lateral direction of the thin wall member 234 of the grid electrode 23.

Each of the fitting members 233A and 233B is disposed symmetrical about a longitudinal axis L1 and disposed symmetrical about a lateral axis L2, which is an axis perpendicular to the longitudinal axis L1.

The grid electrode 23 of the exemplary embodiment of the present invention is the thin, sheet-like member formed of stainless steel such as SUS304, and has the multiple linear patterns 232 extending straightly in the longitudinal direction of the slits 231. Patterning operation of the multiple linear patterns 232 may be performed with etching process, for example.

Figure 7A:
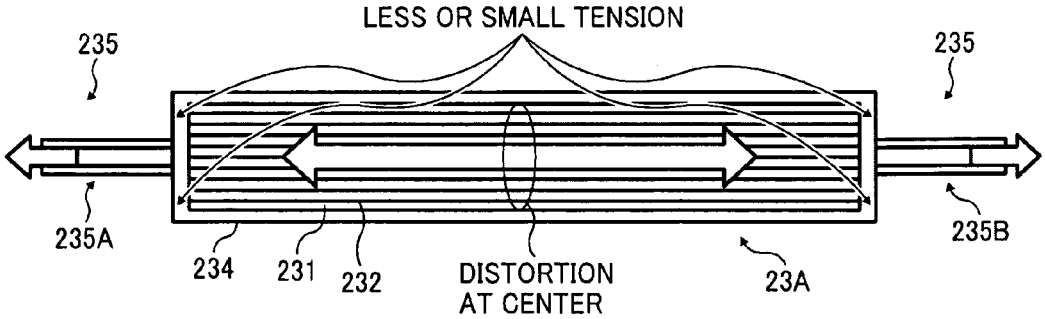
FIG. 7A is an example view of a grid electrode extended at straight fitting members at both ends.

When the fitting members 233A and 233B are formed without the respective pairs of arms 233*b*, it may be difficult to apply and exert uniform tension with respect to the entire area of the grid electrode 23. More specifically, as shown in FIG. 7A, when the scorotron charger 2 includes a grid electrode 23A with fitting units 235 having fitting members 235A and 235B in a straight, armless form, a tension force applied over the grid electrode 23A cannot be distributed equally. That is, the tension force may not be applied to an area in the vicinity of the end portions in the lateral direction of the grid electrode 23A. Therefore, the center portion in the longitudinal direction of the grid electrode 23A may distort, and as a result, potential variations may occur.

Figure 7B:
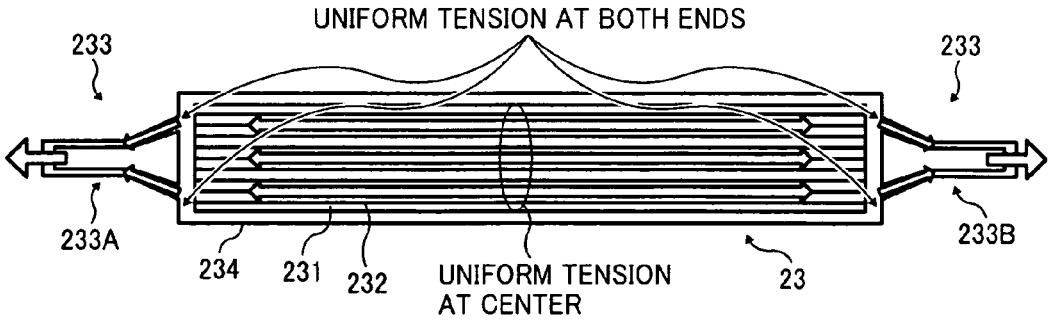
FIG. 7B is a view of the grid electrode of FIG. 5, extended at fitting members with angled arms at both ends.

By contrast, as shown in FIG. 7B, when the grid electrode 23 includes the fitting members 233A and 233B having the respective pairs of arms 233*b* to be extended and engaged with the hooks 251 at the end blocks 25, the tension force can be equally applied over the grid electrode 23, including at or near the end portions in the lateral direction via the pairs of arms 233*b*. Therefore, each component force applied via the pairs of arms 233*b* may become a tension force in a longitudinal direction, and consequently, the tension force may be equally applied in the longitudinal direction over the entire grid electrode 23. Therefore, the tension force may not be applied in a concentrated manner on the center part in the longitudinal direction of the grid electrode 23, and the distortion in a vertical direction or a thickness direction with respect to a surface of the sheet in FIG. 7B may be reduced.

In other words, the dimensions and shapes of the fitting members 233A and 233B, which are locations of the pairs of arms 233*b* with respect to the thin wall member 234 that contains the multiple apertures 231 and the multiple linear patterns 232, are determined so that the tension force in the longitudinal direction can be equally applied over the entire lateral direction of the grid electrode 23.

As previously described, the charge cleaning unit 24 includes the feed screw 241, the slider 242, the grid cleaner pad 243 serving as a cleaning member, and the drive gear 244. The charge cleaning unit 24 has a configuration in which the drive gear 244 rotates the feed screw 241 and the slider 242 moves in forward and backward directions, so that the grid cleaner pad 243 may clean the grid electrode 23.

When the grid cleaner pad 243 moves in the forward and backward directions, the slits 231 and the multiple linear patterns 232 do not have any projecting part or hook. Therefore, the charge cleaning unit 24 can smoothly clean the slits 231 and the multiple linear patterns 232 of the grid electrode 23, without any specific problem such as uneven cleaning or defect cleaning. That is, the multiple linear patterns 232 straightly extend in a moving direction of the grid cleaner pad 243, and therefore the grid cleaner pad 243 may not get jammed or stopped. In such a reciprocating motion, the grid cleaner pad 243 may only produce a constant frictional resistance in a reciprocating motion. According to a small amount of the above-described frictional resistance, even when the apertures 231 are not be formed in a mesh pattern, a desirable mechanical strength can be obtained.

Figure 8A:
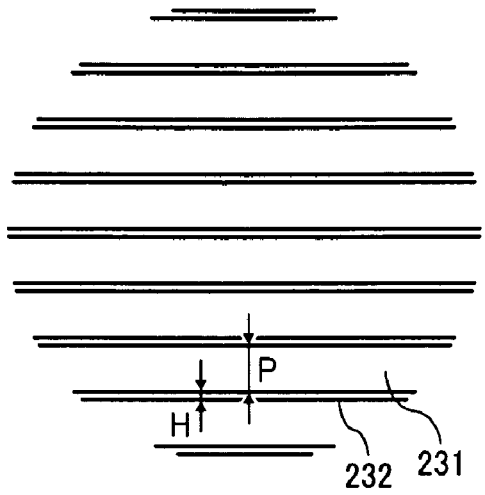
FIG. 8A is a partial plane view showing a relation of apertures and pattern lines of the grid electrode.
Figure 8B:
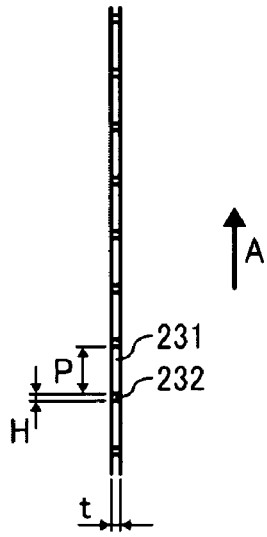
FIG. 8B is a cross-sectional view of the grid electrode in a direction perpendicular to a longitudinal direction of a charge wire.

Referring to FIGS. 8A and 8B, a detailed description is given of the slits 231 of the grid electrode 23. FIG. 8A shows a relation of distances of the apertures 231 and multiple linear patterns 232 of the grid electrode 23, and FIG. 8B shows the grid electrode 23 viewed in a direction perpendicular to the longitudinal direction of the charge wire 21. Arrow "A" in FIG. 8B indicates a rotation direction of the photoconductor 1.

As previously described, the grid electrode 23 includes the multiple apertures 231, and the multiple linear patterns 232 are formed along the multiple apertures 231 in the longitudinal direction but not in the lateral direction of the grid electrode 23. Each interval of the multiple linear patterns 232 or an interval "P" shown in FIGS. 8A and 8B is uniform or equal in the lateral direction. Accordingly, desirable potential controllability of the photoconductor 1 can be obtained.

To extend the grid electrode 23 to form a curved shape or arc shape as shown in FIG. 4, it is preferable that a line width "H" of the multiple linear patterns 232 is equal to or smaller than a thickness plate "t" of the grid electrode 23. In an exemplary embodiment of the present invention, the line width "H" is set to approximately 0.1 mm and the thickness plate "t" is set to approximately 0.1 mm after considering the mechanical controllability.

Further, when an aperture ratio of the grid electrode 23, which is a ratio of the apertures 231 of the grid electrode 23 facing the photoconductor 1 ($\{P/(P+H)\}\times 100$ is set in a range from approximately 80% to approximately 87.5%, the potential controllability of the photoconductor 1 may be enhanced, and image nonuniformity due to charging nonuniformity may not occur.

For example, when the aperture ratio of the grid electrode 23 exceeds or is greater than the above-described range, the grid electrode 23 cannot prevent an adverse affect of spot discharges on the charge wire 21, thereby performing nonuniform charging over the surface of the photoconductor 1.

By contrast, when the aperture ratio of the grid electrode 23 is short of or smaller than the above-described range, a difference between the potential of the photoconductor 1 and the potential of the grid electrode 23 may be too great.

Tables 1-1 and 1-2 show the results of tests for confirmation of the effects of the exemplary embodiments of the present invention.

TABLE 1-1

| No. | Interval Of Pattern Lines "P" [mm] | Width Of Pattern Lines "H" [mm] | Thickness "t" [mm] | Aperture Ratio [%] | Potential Controllability Vg − Vd [V] | Potential Controllability Results |
|---|---|---|---|---|---|---|
| 1 | 0.2 | 0.1 | 0.1 | 66.7 | 65 | Poor |
| 2 | 0.3 | 0.1 | 0.1 | 75 | 43 | Acceptable |
| 3 | 0.4 | 0.1 | 0.1 | 80 | 30 | Good |
| 4 | 0.5 | 0.1 | 0.1 | 83.3 | 21 | Good |
| 5 | 0.6 | 0.1 | 0.1 | 85.7 | 12 | Good |
| 6 | 0.7 | 0.1 | 0.1 | 87.5 | 5 | Good |
| 7 | 0.8 | 0.1 | 0.1 | 88.9 | −6 | Poor |
| 8 | 0.9 | 0.1 | 0.1 | 90 | −15 | Poor |

TABLE 1-2

| No. | Charging Nonuniformity: Image Nonuniformity Level Per Dot | Charging Nonuniformity: Results | Cleaning Ability: Cleaning Nonuniformity, Cleaning Defect | Total Results |
|---|---|---|---|---|
| 1 | 5 | Good | No | Poor |
| 2 | 5 | Good | No | Acceptable |
| 3 | 5 | Good | No | Good |
| 4 | 5 | Good | No | Good |
| 5 | 5 | Good | No | Good |
| 6 | 5 | Good | No | Good |
| 7 | 4 | Acceptable | No | Poor |
| 8 | 2 | Poor | No | Poor |

"H" representing the width of each of the multiple linear patterns 232 of the grid electrode 23 is set to 0.1 mm and "t" representing the thickness of the grid electrode 23 is set to 0.1 mm. "P" representing the interval of the multiple linear patterns 232 is gradually changed in a 0.1 mm unit from 0.2 mm to 0.9 mm. Under the above-described conditions, the following parameters are confirmed:

1) Potential Controllability: Difference between a potential Vg of the grid electrode 23 and a potential Vd of the photoconductor 1;

2) Charging Nonuniformity: Image Nonuniformity Level per Dot after 10,000 sheets are printed; and 3) Cleaning Ability: Cleaning Nonuniformity and Cleaning Defect with respect to the grid electrode 23 after 10,000 sheets are printed and the grid charge cleaning unit 24 is activated.

According to the results shown in Tables 1-1 and 1-2, when the difference between the potential Vg of the grid electrode 23 and the potential Vd of the photoconductor 1 is equal to or smaller than 40V, the efficiency of the scorotron charger 2 can be enhanced, and the results are shown as "Good" in Table 1-1.

[Potential Controllability]

As the aperture ratio increases, the difference between the potential Vg and the potential Vd may decrease. When the aperture ratio reaches 80%, the difference between the potential Vg and the potential Vd may become 30V. When the aperture ratio exceeds 87.5%, the potential Vd of the photoconductor 1 may be greater than the potential Vg of the grid electrode 23. Accordingly, the aperture ratio of 87.5% or above can deteriorate the controllability of the grid electrode 23, and the results are shown as "Poor" in Table 1-1.

[Charging Nonuniformity]

After 10,000 sheets has been printed, the grid electrode 23 and the charge wire 21 may be contaminated with toner and foreign materials, and therefore, the corona discharge of the charging unit 2 may be unstable. This unstable condition may cause multiple spot discharges on the charge wire 21. When the controllability of the grid electrode 23 is not acceptable, the surface of the photoconductor 1 cannot be charged uniformly, which may cause charging nonuniformity. This charging nonuniformity may result in image nonuniformity to be shown, significantly on one dot image.

The level of image nonuniformity of one dot image degrades with the aperture ratio of 87.5% or above, where the controllability of the grid electrode 23 deteriorates, and the results exceeding the aperture ratio of 87.5% are shown as "Acceptable" (88.9%) and "Poor" (90%) in Table 1-2.

[Cleaning Ability]

After 10,000 sheets has been printed, the charge cleaning unit 24 is activated and found no cleaning nonuniformity and/or no cleaning defect under any of the above-described conditions.

Accordingly, the scorotron charger 2 including the grid electrode 23 with the aperture ratio of from approximately 80% to approximately 87.5% can perform desirable scorotron charging.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present patent application, and all such modifications as would be obvious to one skilled in the art are intended to be included within the scope of the following claims.

What is claimed is:

1. A grid electrode disposed facing a charge wire, the grid electrode comprising:

a thin plate member containing:

multiple apertures formed in a longitudinal direction on a surface of the thin plate member of the grid electrode, the surface facing the charge wire; and multiple linear patterns formed in the grid electrode in the longitudinal direction of the grid electrode to form each of the multiple apertures therebetween, the multiple linear patterns disposed at equally-shaped intervals in a lateral direction of the grid electrode; and fitting members having a U-shaped body provided at either end portion in the longitudinal direction of the thin plate member containing the multiple apertures, configured to engage respective hooks mounted on a scorotron charger including the grid electrode, wherein each of the fitting members includes a first arm and a second arm extending outwardly from the U-shaped body in the lateral direction to an end portion of the grid electrode to cause a tension force exerted in the longitudinal direction of the multiple apertures to be applied uniformly over the end portions of the thin plate member in the lateral direction of the fitting members, and wherein each of the fitting members includes a first end for engaging the respective hooks mounted on the charger, and a second end opposite the first end and located closer to the thin plate member along a longitudinal direction of the fitting member, wherein the first arm and second arm extend outwardly from the second end of the fitting member.

2. The grid electrode according to claim 1, wherein the fitting members are symmetrical about a longitudinal axis thereof.

3. The grid electrode according to claim 2, wherein each of the fitting members is symmetrical about an axis perpendicular to the longitudinal axis thereof.

4. The grid electrode according to claim 1, wherein the grid electrode is non-planar in a direction transverse to the longitudinal direction.

5. The grid electrode according to claim 4, wherein the multiple linear patterns formed in the grid electrode are equally spaced apart in the transverse direction.

6. An image forming apparatus, comprising:

an image bearing member configured to bear an image on a surface thereof; and a scorotron charger configured to charge the surface of the image bearing member, the scorotron charger comprising:

a shield case;

a charge wire extended in a longitudinal direction of the shield case; and a grid electrode disposed facing the charge wire, the grid electrode comprising:

a thin plate member containing:

multiple apertures formed in a longitudinal direction on a surface of the thin plate member of the grid electrode, the surface facing the charge wire; and multiple linear patterns formed in the grid electrode in the longitudinal direction of the grid electrode to form each of the multiple apertures therebetween, the multiple linear patterns disposed at equally-shaped intervals in a lateral direction of the grid electrode; and fitting members having a U-shaped body provided at either end portion in the longitudinal direction of the thin plate member containing the multiple apertures, configured to engage respective hooks mounted on the scorotron charger, wherein each of the fitting members includes a first arm and a second arm extending outwardly from the U-shaped body in the lateral direction to an end portion of the grid electrode to cause a tension force exerted in the longitudinal direction of the multiple apertures to be applied uniformly over the end portions of the thin plate member in the lateral direction of the fitting members, and wherein each of the fitting members include a first end for engaging the respective hooks mounted on the charger, and a second end opposite the first end and located closer to the thin plate member along a longitudinal direction of the fitting member, wherein the first arm and second arm extend outwardly from the second end of the fitting member.

7. The image forming apparatus according to claim 6, wherein each of the fitting members includes a part having a given angle with respect to the longitudinal direction thereof, the fitting members symmetrical about a longitudinal axis thereof.

8. The image forming apparatus according to claim 7, wherein each of the fitting members is symmetrical about an axis perpendicular to the longitudinal axis thereof.

9. The grid electrode according to claim 6, wherein the grid electrode is non-planar in a direction transverse to the longitudinal direction.

10. The grid electrode according to claim 9, wherein the multiple linear patterns formed in the grid electrode are equally spaced apart in the transverse direction.

11. A process cartridge detachable with respect to an image forming apparatus, the process cartridge comprising:

an image bearing member configured to bear an image on a surface thereof; and a scorotron charger configured to charge the surface of the image bearing member, the scorotron charger comprising:

a shield case;

a charge wire extended in a longitudinal direction of the shield case; and a grid electrode disposed facing the charge wire, the grid electrode comprising:

a thin plate member containing:

multiple apertures formed in a longitudinal direction on a surface of the thin plate member of the grid electrode, the surface facing the charge wire; and multiple linear patterns formed in the grid electrode in the longitudinal direction of the grid electrode to form each of the multiple apertures therebetween, the multiple linear patterns disposed at equally-shaped intervals in a lateral direction of the grid electrode; and fitting members having a U-shaped body provided at either end portion in the longitudinal direction of the thin plate member containing the multiple apertures, configured to engage respective hooks mounted on the scorotron charger, wherein each of the fitting members includes a first arm and a second arm extending outwardly from the U-shaped body in the lateral direction to an end portion of the grid electrode to cause a tension force exerted in the longitudinal direction to be applied uniformly over the end portions of the thin plate member in the lateral direction of the fitting members, and wherein each of the fitting members include a first end for engaging the respective hooks mounted on the charger, and a second end opposite the first end and located closer to the thin plate member along a longitudinal direction of the fitting member, wherein the first arm and second arm extend outwardly from the second end of the fitting member.

12. The process cartridge according to claim 11, wherein each of the fitting member includes a part having a given angle with respect to the longitudinal direction thereof, the fitting members symmetrical about a longitudinal axis thereof.

13. The process cartridge according to claim 12, wherein each of the fitting member is symmetrical about an axis perpendicular to the longitudinal axis thereof.

14. The grid electrode according to claim 11, wherein the grid electrode is non-planar in a direction transverse to the longitudinal direction.

15. The grid electrode according to claim 14, wherein the multiple linear patterns formed in the grid electrode are equally spaced apart in the transverse direction.

* * * * *